US008602463B2

(12) United States Patent
Keighley et al.

(10) Patent No.: US 8,602,463 B2
(45) Date of Patent: Dec. 10, 2013

(54) LATCH

(75) Inventors: Garth Colin Keighley, Annerley (AU); Andrew John Terei, Taringa (AU)

(73) Assignee: Assa Abloy New Zealand Limited, Albany, Aukland (NZ)

( * ) Notice: Subject to any disclaimer, the term of this patent is extended or adjusted under 35 U.S.C. 154(b) by 354 days.

(21) Appl. No.: 12/670,262

(22) PCT Filed: Jul. 24, 2008

(86) PCT No.: PCT/NZ2008/000185
§ 371 (c)(1),
(2), (4) Date: Jul. 20, 2010

(87) PCT Pub. No.: WO2009/014461
PCT Pub. Date: Jan. 29, 2009

(65) Prior Publication Data

US 2010/0276947 A1 Nov. 4, 2010

(30) Foreign Application Priority Data

Jul. 24, 2007 (NZ) ..... 556675

(51) Int. Cl.
*E05C 1/06* (2006.01)
*E05C 1/00* (2006.01)
*E05C 1/02* (2006.01)

(52) U.S. Cl.
USPC ..... 292/143; 292/32; 292/137; 292/138; 292/DIG. 47; 292/DIG. 37; 292/DIG. 20

(58) Field of Classification Search
USPC ..... 292/143, 42, 145, 2, 32, 33, 37, 38, 41, 292/57, 111, 137, 159, 200, DIG. 47, 292/DIG. 53, DIG. 20, DIG. 37; 49/394, 395
See application file for complete search history.

(56) References Cited

U.S. PATENT DOCUMENTS

| | | | | |
|---|---|---|---|---|
| 1,258,247 | A * | 3/1918 | Rinker | 49/394 |
| 2,293,536 | A * | 8/1942 | Fenn | 49/145 |
| 4,300,794 | A | 11/1981 | Dunsmoor | |
| 4,955,159 | A * | 9/1990 | Rogers | 49/161 |
| 7,731,251 | B2 * | 6/2010 | Ye | 292/163 |
| 8,083,271 | B2 * | 12/2011 | Vilhauer | 292/137 |
| 8,177,265 | B2 * | 5/2012 | Stevens | 292/177 |
| 8,182,001 | B2 * | 5/2012 | Tremble et al. | 292/32 |
| 2003/0110699 | A1 * | 6/2003 | Eenigenburg et al. | 49/185 |
| 2008/0179896 | A1 * | 7/2008 | Chung | 292/164 |

FOREIGN PATENT DOCUMENTS

| | | |
|---|---|---|
| AU | 2003/203786 | 11/2003 |
| GB | 2 153 903 | 8/1985 |
| GB | 2 305 960 | 4/1997 |

* cited by examiner

*Primary Examiner* — Carlos Lugo
*Assistant Examiner* — Faria Ahmad
(74) *Attorney, Agent, or Firm* — DeLio & Peterson, LLC

(57) ABSTRACT

A latch which is suitable for latching a window in a closed and sealed position. The latch has latch furniture 10 adapted to fit into a window section S with minimal protrusion from the section. The furniture includes a sealing lever handle 17 and a latch release handle 16 located in a recess 15 in the latch furniture. The latch further includes a latch mechanism 11 adapted to engage with the latch furniture 10. The latch mechanism 11 has one or more latch bolts 65 operable by the latch release handle 16 and a latch pin 41 engageable with a striker assembly which is mounted to a section of a window frame. The latch pin 41 is coupled to the sealing lever 17 whereby operation of the sealing lever 17 moves the window section S into a sealing position relative to the striker assembly.

21 Claims, 6 Drawing Sheets

LATCH

This application is a National Stage Application of PCT/NZ2008/000185, filed 24 Jul. 2008, which claims benefit of Serial No. 556675, filed 24 Jul. 2007 in New Zealand and which application(s) are incorporated herein by reference. To the extent appropriate, a claim of priority is made to each of the above disclosed applications.

BACKGROUND TO THE INVENTION

This invention relates to a latch, more particularly a latch suitable for latching a window in a closed and sealed position.

Current window fasteners for aluminium awning and casement windows are of a lever handle type which will generally be surface mounted to the interior face of the window sash. These handles have a dual purpose of acting as a handle to pull the window sash closed and also to clamp the window sash to the frame for security and weather sealing.

Weather sealing is achieved by a tongue attached to the lever-handle that acts against a wedge attached to the window frame. Thus, when the lever is rotated the tongue slides along the wedge. This causes the window to be pulled tight against weather strips joined to the aluminium section. The lever is large enough to allow the user to comfortably pull a large window closed and also to generate enough torque to effect the sealing of the window.

Variations of the lever-handle include versions where the wedge is a mechanical device attached to the fastener so that a separate wedge is not required on the window frame. Another variation is a lever that includes two tongues so that a vented position can be achieved. The vented position allows the window to be opened far enough to allow air flow past the window seals to provide semi-secure house venting.

A new type of sliding door system is being developed by a window manufacturer that requires windows to be mounted on the sliding door panel. In this case, the sliding panel slides on the external side of the sliding door system so that any open windows will freely pass a fixed vertical frame member. Clearance between the sliding stile and fixed vertical frame member is thus limited. Consequently any latch furniture associated with the sliding door can only have a maximum protrusion when in the latching position so as to provide sufficient clearance.

It is an object of the present invention to provide a latch for a window wherein the latch has minimal protrusion from the surface of the window.

SUMMARY OF THE INVENTION

The object of the invention is achieved by providing a latch of a construction whereby pulling and sealing levers/handles along with latching and sealing mechanisms can be recessed in the window.

The inventive concept embodied in the latch resides in latch furniture adapted to fit into a window section with minimal protrusion from the section, the furniture including a sealing lever handle and a latch release handle located in a recess in the latch furniture, the latch further including a latch mechanism adapted to engage with the latch furniture, the latch mechanism having one or more latch bolts operable by the latch release handle and a latch pin engageable with a striker, the latch pin operably coupled to the sealing lever whereby operation of the sealing lever moves the window section into a sealing position relative to the striker.

In a preferred form of the invention the latch further includes presentation means whereby the release handle can be projected from the latch furniture to be useable as a window pull.

According to a preferred form of the invention the sealing lever is mounted for pivotal movement. The latch mechanism includes means for translating the pivotal movement of the sealing handle into a linear movement of a latch pin. The latch can further include a first biasing means arranged to be operable to return the release handle to a rest position within the recess upon the release handle having operated the latch bolt(s). It can further include a second biasing means arranged to be operable to return the release handle to within the recess from its projected window pull position.

In one embodiment the release handle is engaged with a pivotally mounted latch bolt lifter which is operable upon the release handle being actuated, the latch bolt lifter being engaged with the lift bolt such that pivotal movement of the lifter is translated into a linear movement of the latch bolt. Preferably there are two latch bolts and the release handle has a pair of support elements coupled thereto, each support element being moveably coupled to the latch furniture and engageable with a respective bolt lifter.

Preferably the latch includes a mechanism to cause the support elements to move simultaneously. The mechanism can be a shaft with a pair of spaced apart toothed pinions each toothed pinion engaged with a respective support element via a toothed track of the support element.

The means for translating can be a carriage slide which is slidingly mounted on a sliding carriage to which is coupled the latch pin; the carriage slider is pivotally coupled to the sealing lever handle, the sliding carriage being mounted for linear movement.

The latch is preferably in combination with a striker. The striker includes a cam-track in which the latch pin is slidingly engageable.

The cam-track insert preferably includes a curved slot which extends from an open end through which the latch pin can enter the slot.

The strike preferably in one form of the invention includes a slot which curves away from an open end via which the latch pin can enter the slot, the latching mechanism being arranged such that the latch pin is moveable by the sealing lever handle into a position in the length of the slot to in use seal closed a window and a position at the open end to in use permit a window to be in a venting position with the latch bolt(s) engaged with the strike.

The latching mechanism preferably includes a lever mechanism which upon the latch bolts being operated to release from the strike applies a force to the release handle to cause the release handle to move to a position projecting from the latch furniture such that it can function as a window pull, the lever mechanism further being arranged to restrict movement of the latch pin when the latch bolt(s) are not engaged with the strike.

In one preferred form the slot is formed as part of a cam-track insert which is removably engaged with a strike mounting base.

In one form of the strike there is positioned adjacent the open end of the slot a damping arm to in use dampen impact by the latch pin.

The latch furniture preferably includes stops to limit the extent of movement of the release handle during operation thereof.

The handle presentation means can in one form of the invention include pivotally mounted handle levers arranged to apply a force to the release lever upon the latch having been actuated to a release position.

Preferably there is further included an anti-slam mechanism arranged to prevent movement of the latch pin other than when the latch bolts are in a latching position.

BRIEF DESCRIPTION OF THE DRAWINGS

In the following more detailed description of the invention reference will be made to the accompanying drawings in which:—

DETAILED DESCRIPTION OF A PREFERRED EMBODIMENT OF THE INVENTION

Typically the clearance that will exist between the sliding stile and a fixed vertical frame member of a sliding door system will be in the order of 2.5 mm. Thus, the maximum protrusion of the latch furniture will need to be in the order of 2 mm when the latch is in the latched and sealed position. As stated above, this is achieved by recessing sealing and pulling handles/levers as well as the latching and sealing mechanism inside the section (typically aluminium) of the sash.

Figure 1:
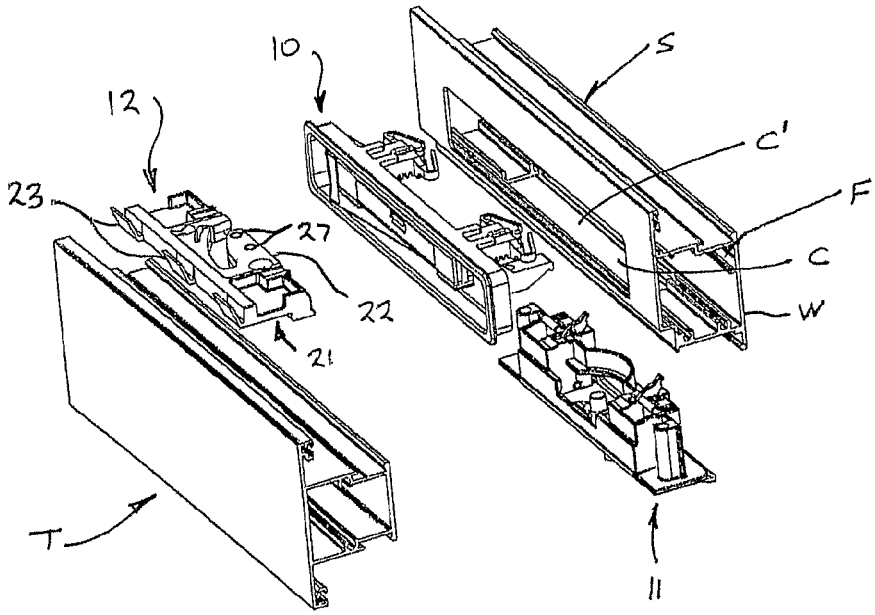
FIG. 1 is an exploded view of the latch in conjunction with sections of a stile and a window sash.
Figure 3:
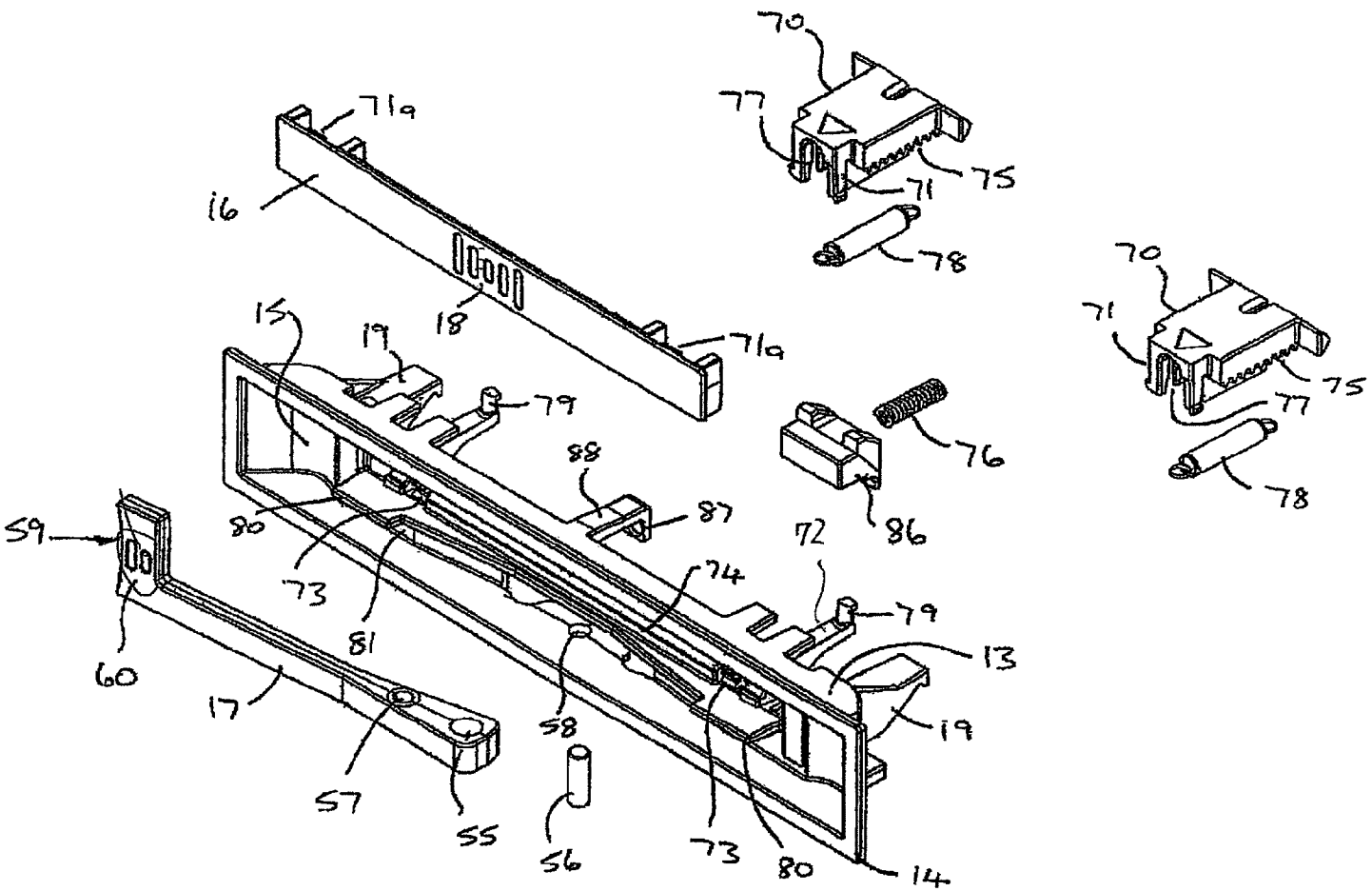
FIG. 3 is an isometric exploded view of the latch furniture of the latch.
Figure 4:
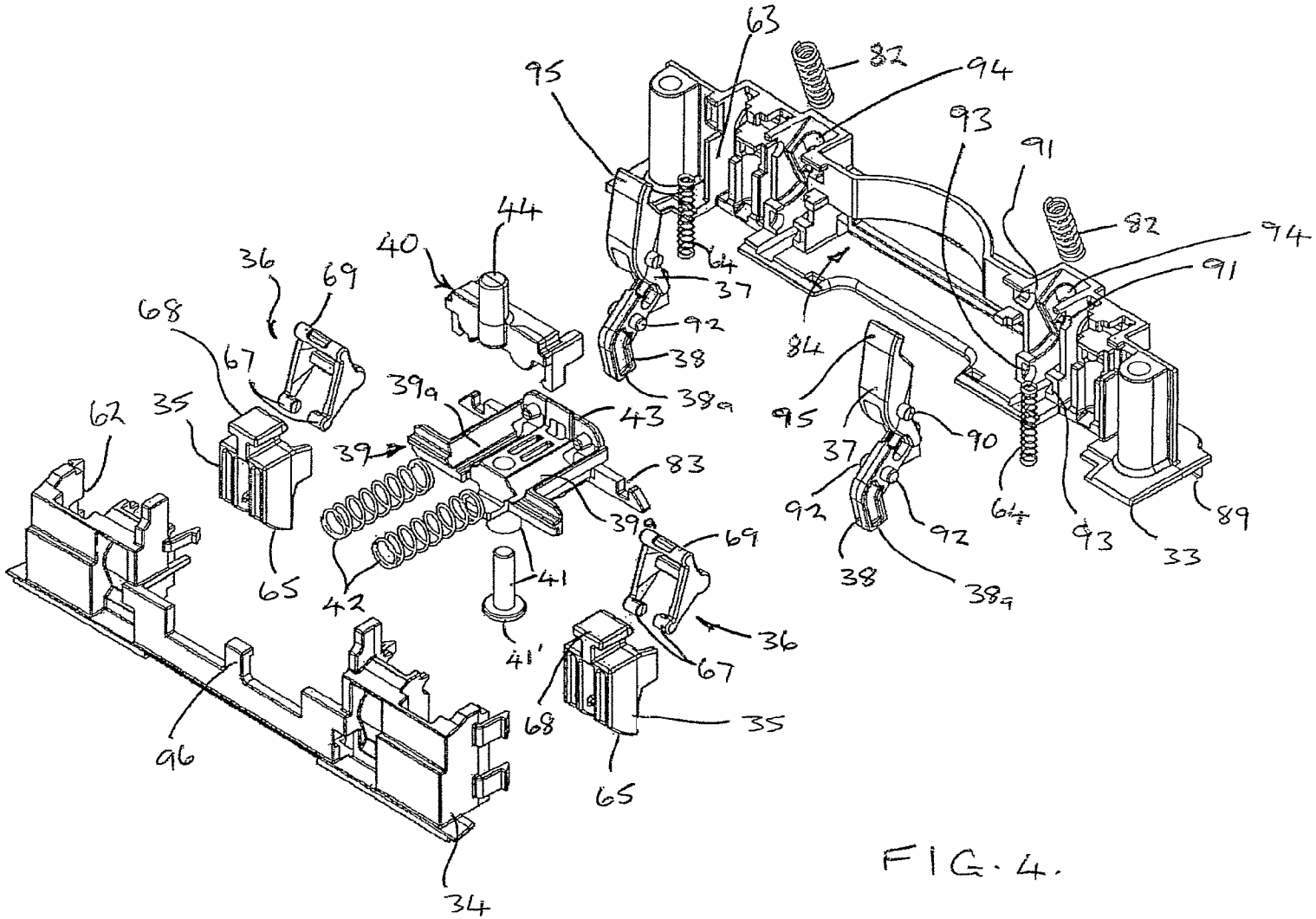
FIG. 4 is an isometric exploded view of the latch mechanism assembly of the latch.
Figure 5:
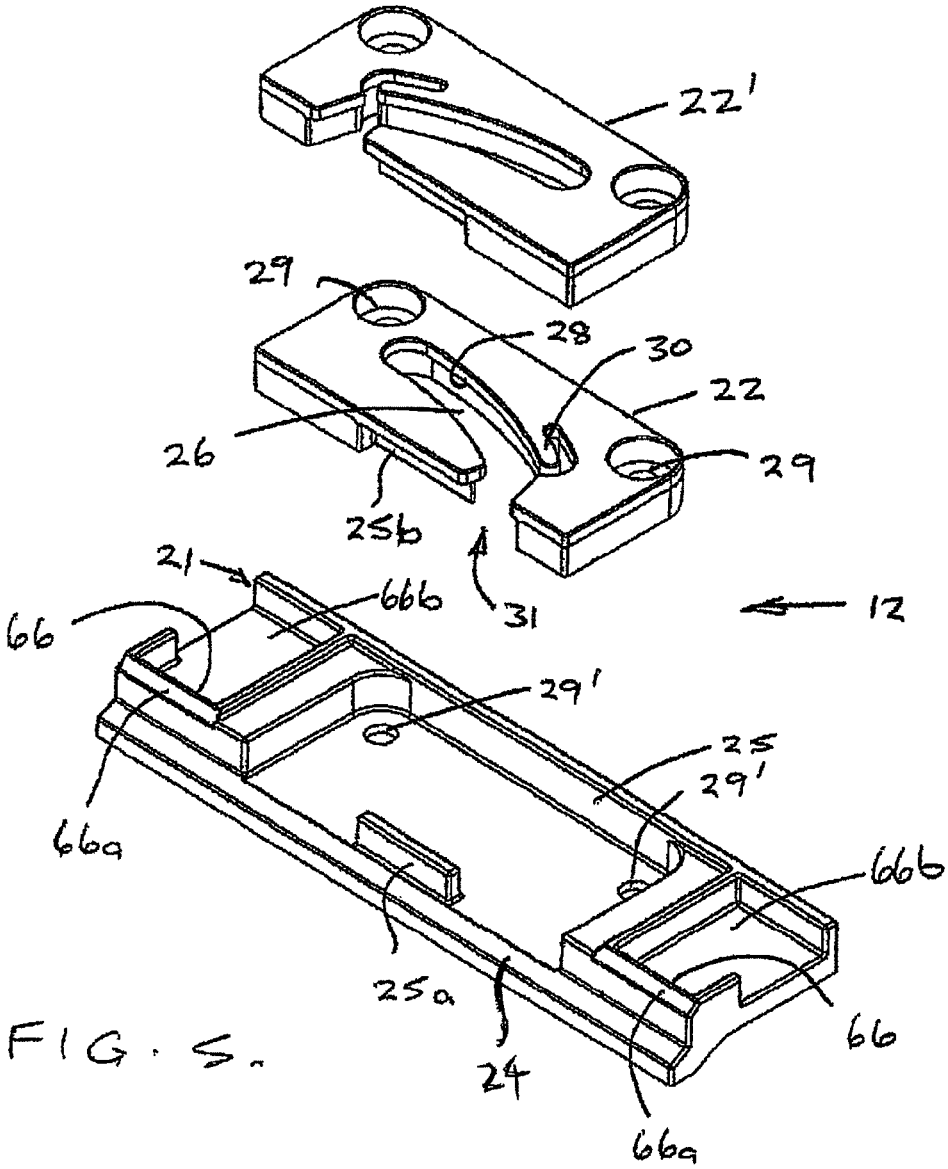
FIG. 5 is an isometric exploded view of the strike assembly of the latch.
Figure 6:
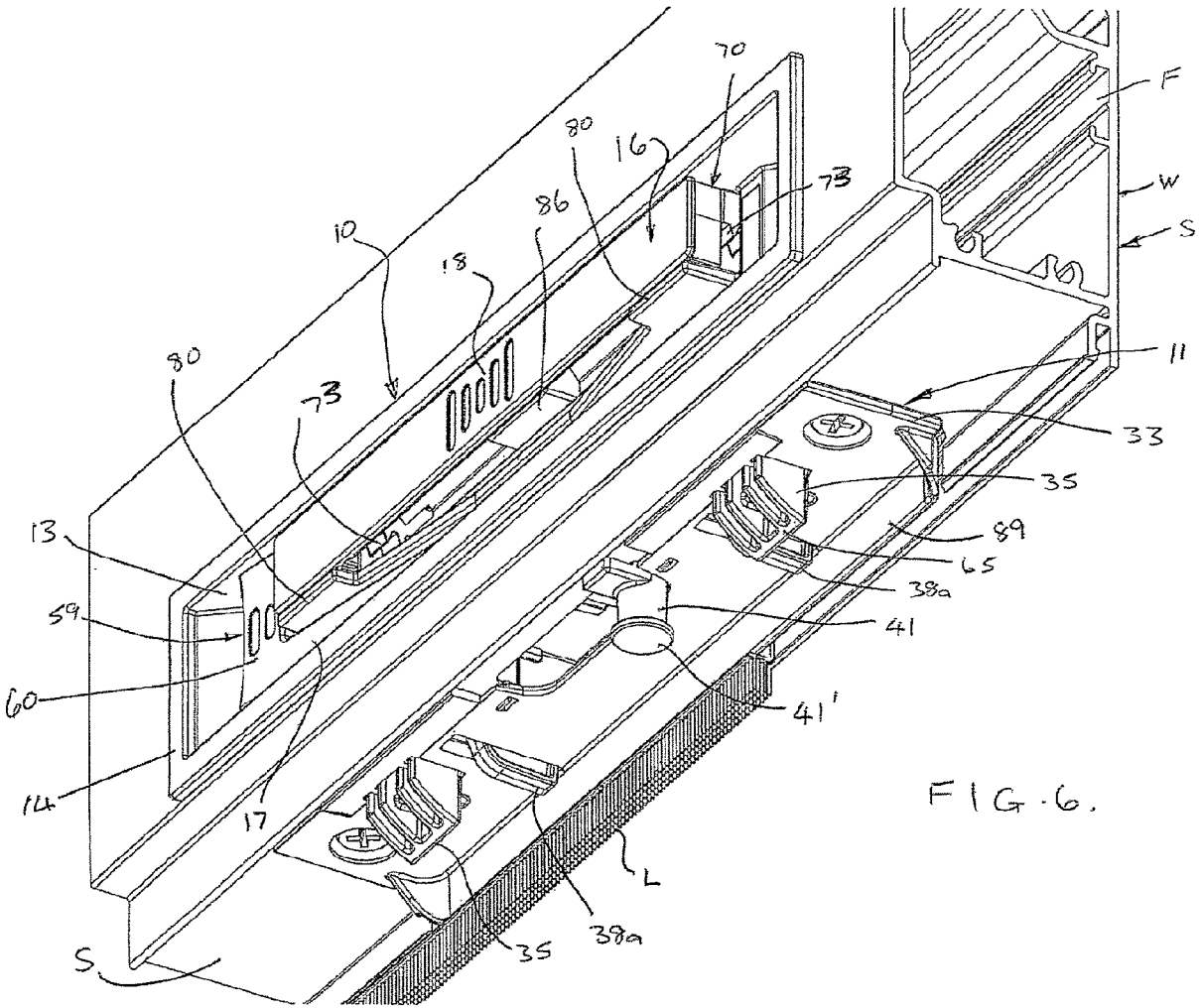
FIG. 6 is an isometric view of the latch furniture and the latch mechanism installed in the sash section, only part of the full length of the sash section being shown.

As is evident from FIG. 1 the drawings, the latch has three separate assemblies namely a latch furniture assembly 10 (FIG. 3), a latch mechanism assembly 11 (FIG. 4) and a striker assembly 12 (FIG. 5). FIG. 1 shows the relative positions of these three assemblies to the stile T and the sash S sections, while FIGS. 2*a*/2*b* show the assemblies installed in the stile T and sash S sections. FIG. 6 shows the latch furniture and the latch mechanism assembly in the sash section. FIG. 6 shows only a partial length of the sash section.

Figures 2A, 2B, 2C, 2D, 2E:
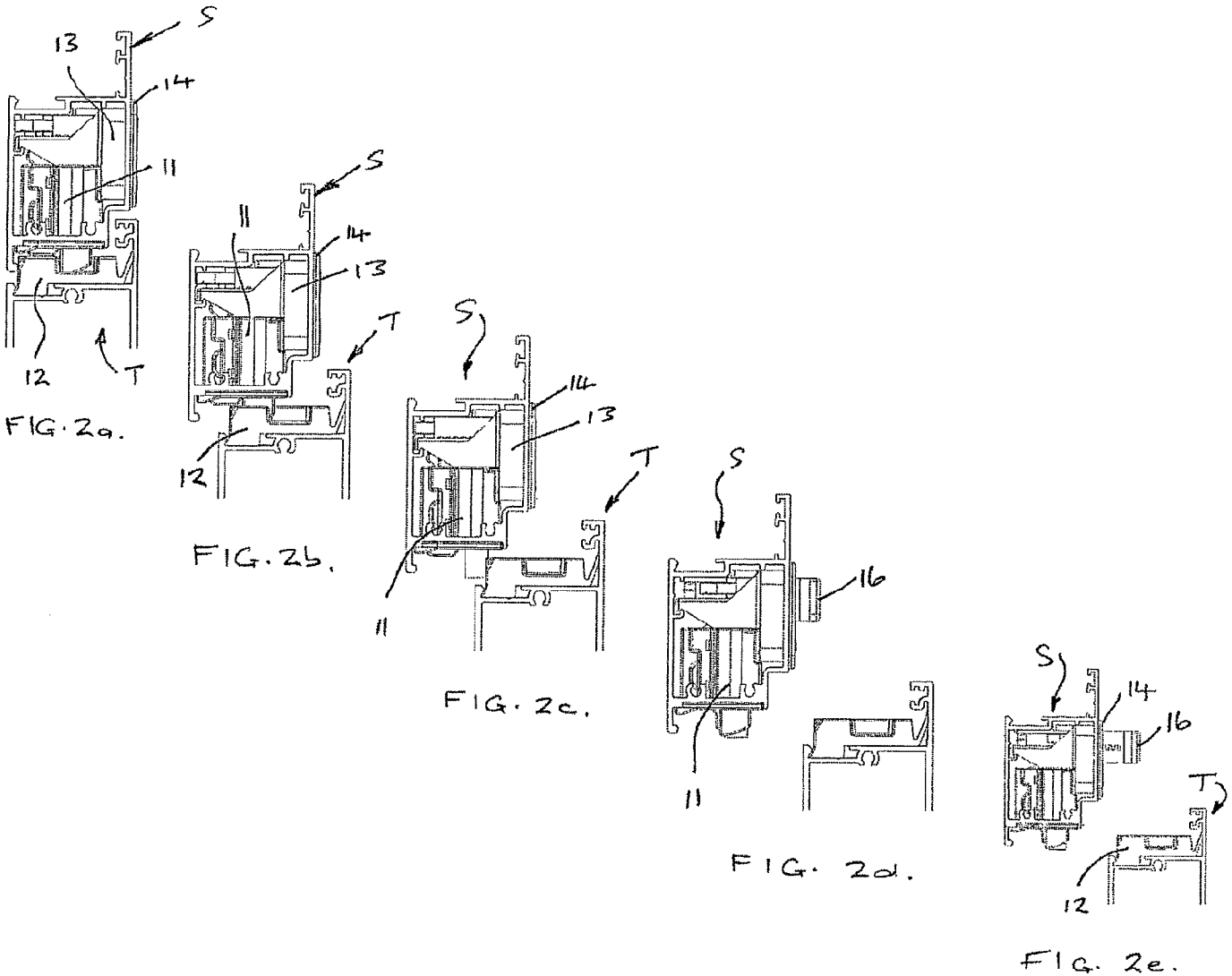
FIGS. 2*a* to 2*e* are a series of cross-sectional illustrations of the assembled latch and window/sash sections illustrating from left to right the progression of a window sash moving from a closed and sealed position to an open position relative to a stile.

FIGS. 2*a* to 2*e* illustrate how the latch has three positions namely closed and sealed (FIG. 2*a*), vented (FIG. 2*b*) and open (FIGS. 2*c* and 2*d*). FIG. 2*e* also shows the sash open but in a closed position (partially open position?).

FIG. 1 shows the three assemblies 10, 11 and 12 in conjunction with a length of an aluminium sash extrusion S and a length of an aluminium transom or stile extrusion T.

A cut out C is routed out of the surface of the sash section S which, in use, is the internal face of the section S. A cut out C' is routed out of the bottom surface of the sash section S. The latch furniture 10 is fitted in cut out C and the latch mechanism assembly 11 is fitted through cut out C' (see FIG. 6).

The furniture sub-assembly 10 is installed into cut out C so that flange 14 around the faceplate 13 sits against the internal face of extrusion S. Next, the latch mechanism sub-assembly 11 is inserted into the bottom cut out C' to meet with the furniture assembly 10 inside section S.

Two screws (not shown) are used to fix the latch mechanism 11 to the furniture 10. As the screws are tightened, the two sub-assemblies 10 and 11 mate together pulling down onto a pair of lugs that sit against the internal horizontal wall within the sash extrusion (acting as a datum face) and pull faceplate extrusion supports (or mating tabs) 19 of the faceplate 13 tight onto a back extrusion feature F (see FIG. 1) of sash S thus completing the latch/furniture assembly.

The latch furniture assembly 10 includes (as will hereinafter be described in more detail) a latch button/handle 16 and a sealing lever 17. As will be described the latch button/handle 16 is engaged in recess 15 of faceplate 13 and is operable to move inwardly and outwardly in the recess 15. Engraved into central formed pressing area of the latch button/handle 16 is a symbol 18 that provides a cue for the user to press this area to open the window.

The sealing lever 17 is an over-centre lever as will hereinafter be described.

Referring now to FIG. 5, the striker assembly 12 is made up of two parts. Namely a striker base 21 and a cam-track insert 22. The striker base 21 is, in the preferred form of the invention, made from a polymeric material. FIG. 5 shows two inserts 22. At installation of the striker assembly the correct insert for the required handing of the latch will be selected.

In the preferred form of the invention the extrusion section T has a profile into which a wedged leading edge 24 of the striker base 21 can fit.

In one form of the striker assembly (see FIG. 1) integral spring elements can be included. These springs 23 engage against part of the section T to thereby ensure engagement between the leading edge and the profile of section T. In this way the base 21 is held temporarily engaged with the extrusion while final alignment and screw fitting of the base to the section T is carried out.

The cam-track insert 22 engages in a recess portion 25 of the striker base 21. The cam-track insert 22 is removable. By using a mirrored version 22' of the cam-track insert the latch mechanism can be handed right. Thus depending on the requirements of the end user insert 22 or 22' will be employed.

The cam-track insert 22 includes a track 26 along which a carriage pin 41 (hereinafter described) of the latching mechanism 11 slides to seal the window. Positioning holes 27 (see FIG. 1) can in one form of the invention be provided in the cam insert 22. These engage on pins which extend upwardly from the floor of the recess 25. These pins and positioning holes 27 thereby ensure correct alignment within the striker base 21 and also increase strength of the striker assembly.

A boss feature 25*a* upstanding from the recess 25 on the base 21 provides additional strength to the striker assembly and a corresponding recess 25*b* in the track insert 22.

A lip 28 is preferably formed on the top face of the cam track 26. This prevents the latch carriage pin 41 (due to the "T" shape of the head thereof) from disengaging with the striker when load is applied between the two extrusion sections S and T. The T shaped head (in cross section) of the pin 41 runs underneath the lip 28 to thereby achieve this functionality.

The cam-track 26 guides the carriage pin 41 to either a sealed position or a vented/open position.

Counterbored openings 29 in the cam-track insert 22 are used to fix the striker assembly to the extrusion T. Screws (not shown) pass through these openings 29, openings 29' of the striker base 21 and into the extrusion T. These screws therefore lock the cam-track insert 22 and striker base 21 together for additional strength to withstand the forces required to compress the window seals.

An additional feature of the cam-track insert 22 is a damping arm 30. This damping arm 30, which is formed integrally with the cam-track insert 22, deadens the blow from a slammed window where the carriage pin 41 hits against the arm 30 adjacent the entrance 31 to the track 26. This, therefore, minimises the risk of damage to either the striker 12 or the latch mechanism 11.

Turning now to the latch mechanism 11, which is shown in more detail in FIG. 4, this sub-assembly includes a base 33, a lid or cover 34, bolts 35, bolt lifters 36, handle levers 37, anti-slam levers 38, carriage 39 and carriage slide 40. With a view to ease of assembly features are preferably designed into this mechanism in accordance with known engineering design techniques whereby all of the parts either interlink or snap fit in place. These features will be readily apparent to the skilled person by reference to FIG. 4.

As will hereinafter be described, operation of the latch mechanism 11 is controlled remotely either by the furniture assembly 10 or through contact with the striker assembly 12.

The assembly of the latch mechanism 11 and the interaction of the various parts thereof will be apparent from the following description of the operation of the latch mechanism.

Sealing and removal of the sealing effect is achieved via the sliding carriage 39. The protruding carriage pin 41 of sliding carriage 39 slides in the track 26 of the cam-track insert 22. This sliding action is achieved by swinging the sealing lever 17 of the furniture assembly 10 over 180°.

The carriage pin 41 contains a headed stainless steel pin 41' that provides additional strength to the carriage 39 but also the head thereof prevents the latch mechanism 11 and striker 12 from separating as described earlier.

The carriage slider 40 is engaged with and slidingly moves in the top of the carriage 39. The carriage slider 40 is biased by the presence of two springs 42 which are engaged in hollows 39*a* in the sliding carriage 39. Springs 42 engage between a flange 43 of the sliding carriage 39 and a surface of the carriage slider 40.

The carriage slider 40 has the dual purpose of creating an over-centre action for the sealing lever 17 via the use of the two springs 42 and also to turn the radial action of the sealing lever 17 into a linear movement of the carriage/locking pin 41.

The slider 40 has an upstanding spigot 44. This engages in an opening 55 in the sealing lever 17. The sealing lever 17 is held in place in the furniture faceplate 13 by a push fit pivot pin 56. This pin 56 engages through a bore 57 in the lever 17 and engages at its opposite ends in opposed openings 58 formed in the faceplate 13. Only one of the openings 58 is visible in FIG. 3. An "L" shaped detail 96 of the cover 34 of the latch mechanism assembly 12 is used to hold the lever pin 56 in the face plate 13.

The extreme distal end of the lever 17 includes a scalloped styling form 59 and also an engraving which invites the user to use a finger to pull the distal end of the lever 17. As the lever 17 is rotated from its position located within the recess 15 (see FIG. 1), it pivots about the axis of the pivot pin 56 and the coupling between the spigot 44 and opening 55 results in a horizontal sliding action of the slider 40.

The sealing of a window in the closed position and release from that sealed position is therefore achieved by the sealing lever 17. The vented position is indicated by the use of either a self-adhesive indicator or polymer clip-in part 60 either on the lever itself or in the furniture recess 15.

Reverting back to the latching mechanism as shown in FIG. 4, latching bolts 35 are mounted for vertical movement in a track which is formed by the combination of the track section 62 of the cover 34 and track section 63 of the latch base 33. These combined track sections 62 and 63 also provide travel stops to limit the extent of movement of each of the bolts 35. The bolts 35 are sprung by compression springs 64 which bias the bolts to extend out of the latch.

Ramps 65 on the bolts 35 act against the striker so that when the window is closed the bolts 35 ride up and over a wall 66 which, as shown in FIG. 5, preferably has an inclined leading surface 66*a*. Thus, as the window is closed the bolts 35 ride up the leading surfaces 66*a* and over walls 66 into shallow recess 66*b* to a self-latched vented position.

When the push button 16 is activated it pushes against the bolt lifters 36 which are pivotally mounted in a pair of pivot bushings formed by the joining of the bolt track sections 62 and 63. The bolt lifters 36 each have a pair of opposed spigots 67. A "T" section top section 68 of the bolts 35 inter-engages with the bolt lifter 36 so that the spigots 67 engage beneath the top cross-piece of the top section 68.

Accordingly, when the furniture push button 16 is activated i.e. pushed inwardly it pushes against the contact surface 69 of the bolt lifters 36 so that the bolt lifters 36 pivot and bolts 35 are lifted out of recess 66*b* and hence engagement with the striker assembly 12. The window is then free to open. Once the button 16 is released the bolts 35 extend, under the action of the spring 64, to their natural projecting position.

The push button 16 is connected to the furniture faceplate 13 via a pair of polymer supports 70. Each support 70 has a profiled end section 71 that fixes into a tee-slot 71*a* (and clips therein) in the handle 16. The support 70 has a longitudinal groove into which a block 72 of the faceplate 13 slidingly engages. This arrangement provides the necessary guide for reciprocal movement of the supports 70.

In a preferred form of the invention a mechanism is included to ensure that the support 70 moves simultaneously. The mechanism is a pair of mated polymer pinions 73 coupled by shaft 74. The pinions engage with racks 75 of the supports 70. The rack and pinion arrangement thus keeps the handle/button 16 from "racking" and in doing so, ensures that the supports 70 simultaneously activate the bolt lifters 36 to pull the two latch bolts 35 out of the striker assembly 12.

A compression spring 76 acts on a sliding polymer handle stop 86 so that when button 16 is depressed inwardly, the compression spring 76 and handle stop 86 combination returns the button 16 to the flush position in recess 15. The compression spring 76 acts against a backstop 87 formed into a stalk 88 on the rear of the faceplate 13.

A mount 77 for a wire retention return spring 78 is also incorporated into the moulding of the support 70. The return spring 78 pulls the button 16 back to the flush position when the button 16 has been used as a pull handle to close the window. The faceplate 13 further includes mounts 79 for the other ends of the springs 78.

The faceplate 13 also includes stops for limiting the extent of movement of the button handle 16 and the over-centre sealing lever 17. The stops 80 provide the end stops for the button 16 and the stops 81 for the lever 17.

Reverting now to FIG. 4, the handle levers 37 and anti-slam levers 38 form a dual purpose mechanism that sits beside the latch bolts 35. The mechanism is used primarily as a handle presenting device but also provides an anti-slam feature.

Handle lever 37 has a pair of spigots 90 (one projecting from each side of the lever 37) which are rotatably engaged in spaced apart recesses 91 of base 33. Similarly spigots 92 of the anti-slam levers 38 engage in opposed recesses 93. The handle lever 37 is coupled by a clip together sliding coupling to the anti-slam lever 38 as shown in FIG. 4.

A spring 82 is engaged at one end in recess 94 while the other end of the spring 82 engages with the distal end 95 of the handle lever 37.

A handle presentation feature actuates when the window is in the open (clear of the striker assembly) position where the handle levers 37 push against the rear of the handle supports 70. The handle levers 37 are spring biased by the springs 82. The handle levers 37, therefore, always push the handle 16 out but are limited in doing this by the anti-slam levers 38 which are driven by the handle levers 37 and springs 82.

The distal ends 38*a* of the anti-slam levers 38 can project through base 33 as shown in FIG. 6. The anti-slam levers 38 can thus also engage in the striker assembly 12.

When the anti-slam levers 38 are engaged in the striker assembly 12, the handle levers 37 fold out of the way of the handle support 70 allowing the button 16 to return to its resting position (against the polymer handle support springs 76) or to be depressed without interference from the handle levers 37. When the anti-slam levers 38 have disengaged with the striker assembly 12 the handle levers 37 are allowed to spring out thus, pushing the button/handle 16 out from the recess 15 of the furniture faceplate 13 and in doing so present the button/handle 16 so that it is able to be used as a pull handle.

The second purpose of this mechanism is to act as an anti-slam device where the sliding carriage 39 is only able to slide when the window system is in either the closed or vented position. To this end an interlocking feature 83 on either side of the carriage 39 slides into a recess 84 in the latch base 35 where it crosses the path of either of the anti-slam levers 38. When the window is open (mechanism is disengaged from the striker assembly) the anti-slam levers 38 swing down (by the springing action of the handle levers 37) so that they engage with the interlocking feature 83 of the carriage 39 thus, preventing it from being driven by the lever 17.

When the window is pulled closed and the anti-slam levers 38 again contact the strike assembly 12, they disengage from the carriage 39 therefore allowing the carriage 39 to be moved.

The intention of this anti-slam device is to stop the carriage 39 from being maneuvered into a position where the carriage pin 41 is misaligned with the striker track 26 which could cause the latch to be damaged as the window is pulled closed.

With the foregoing description of the construction of the latch in mind, the operation of the latch can be further understood.

In the closed and sealed position (FIG. 2*a*) the sealing lever 17 and the button/handle 16 are contained within the recess 15 of the faceplate furniture 13 and are flush with the furthermost protruding rim 14 of the furniture faceplate 13. The window sash is pulled tightly against the weather strip (seals) via the sliding carriage pin 41 attached to the carriage 29 that is activated by rotating sealing lever 17, 180° within the furniture 10. The carriage pin 41 slides along track 26 of the striker assembly 12 and in the sealed position the track 26 is closer to the inside of the window so that the seals are compressed.

A venting position is achieved by rotating the sealing lever 180° in the opposite direction which moves the carriage locking pin 41 to the other end of the slider track 26. The movement of the carriage locking pin 41 along the path of the striker track 26 effectively jacks the window sash out about a distance which, in the preferred embodiment of the invention, is approximately 10 mm. The carriage locking pin 41 at this point is free to move out of the striker via the entrance 31. However, the window is held in this "secure vented" position by the two spring loaded latch bolts 35 which engage behind the walls 66. This vented position is shown in FIG. 2*b*.

In order to get the window to fully (or partially) open, the button handle 16 is depressed in a push button action. The bolt lifters 36 convert the horizontal motion of the push button 16 to a lifting action on the lift bolts 35 thereby lifting the latch bolts to disengage them from the striker. This allows the window to be pushed open (FIGS. 2*c*-2*d*).

When it is desired that the window be closed, the sash is moved in the closing direction (FIG. 2*e*) and, as previously described, this causes the latch bolts 35 to automatically ride over slopes 66*a* and walls 66 to once again relatch into the striker base 21. The sealing lever 17 can then be operated when the window is in the fully closed position to once again drag in the sash to compress the seals.

An additional feature incorporated into the latch assembly is a seal support. If required an additional weather seal L can be included in the window system. The seal L is retained in a groove G that is part of the aluminium extrusion (section) S. Because the rout that is cut into the extrusion S to form the cut out C' for the latch mechanism removes a portion of the groove G, the added detail or flange 89 on the latch mechanism base 33 replaces the lost portion, thereby restoring the continuous groove G required in the sash section S to accommodate the wiping seal L continuously along the full length of the sash section S.

In the preferred form of the invention the latch furniture 10 contains visible parts that will be made of zinc alloy in order to allow for numerous finishing options. The mechanism parts can be selectively made out of polymer and steel.

Latch handing means that the furniture lever 17 can be operated to the left or to the right for unsealing. This gives the customer/end user the option of making all levers point the same direction or in opposite directions when two latches may be required in large windows for symmetrical left and right handed operation. The window fabricator decides how the latch will be handed by selecting the appropriate strike insert 22 or 22'. The appropriate left-hand 22 or right-hand 22' version of the strike insert can be fitted so that the track 26 for the locking pin 41 is thus reversed thereby reversing the handing.

The present invention thus provides a non-handed, self-latching, manual sealing awning/casement window latch with flush furniture in the closed position. It also provides for automatic presentation of the button handle in the open position so that the button handle can be used as a pull for pulling the window closed. The invention provides a latch which has minimal protrusion thereby enabling the latch to be used with a window which may need to move relative to a fixed element such as a window on a sliding door having to move past (when in the closed position) a vertical frame member of the sliding door system.

It will be appreciated by the skilled person that the foregoing is a description of one preferred form of the invention and that the invention is capable of modification within the scope of the invention as defined in the following claims.

What we claim is:

1. A latch which includes latch furniture adapted to fit substantially within a window section, the latch furniture including a recess in which a sealing lever handle and a latch release actuator are located, the latch further including a latch mechanism adapted to engage with the latch furniture, the latch mechanism having:

one or more latch bolts engageable with a striker to define a closed position, the latch bolts being operable by the latch release actuator; and a latch pin engageable with the striker, the latch pin coupled to the sealing lever handle and operable whereby operation of the sealing lever handle when the latch mechanism is in the closed position moves the window section between a sealing position and a venting position relative to the striker, wherein the latch bolts are engaged with the striker in both the sealing and secure venting positions;

wherein, in an installed window: in the sealing position the window section is positioned to seal an opening in a window frame and in the secure venting position air is permitted to flow through the opening.

2. The latch as claimed in claim 1 wherein when the latch is in an open position the latch release actuator projects from the latch furniture to be useable as a window pull.

3. The latch as claimed in claim 2 further including a first biasing means arranged to return the latch release actuator to a rest position within the recess upon the latch release actuator having operated the latch bolt(s).

4. The latch as claimed in claim 3 further including a second biasing means arranged to return the latch release actuator to within the recess from its projected window pull position.

5. The latch as claimed in claim 1 wherein the latch release actuator is engaged with one or more pivotally mounted latch bolt lifters which are operable by the latch release actuator, the one or more latch bolt lifters being engaged with the one or more latch bolts such that pivotal movement of the one or more latch bolt lifters is translated into a linear movement of the one or more latch bolts.

6. The latch as claimed in claim 5 wherein there are two latch bolts and the latch release actuator has a pair of support elements coupled thereto, each support element being moveably coupled to the latch furniture and engageable with a respective latch bolt lifter.

7. The latch as claimed in claim 6 wherein the support elements are coupled such that they move simultaneously.

8. The latch as claimed in claim 7 wherein the support elements are coupled by a shaft with a pair of spaced apart toothed pinions each toothed pinion engaged with a respective support element via a toothed track of the support element.

9. The latch as claimed in claim 1 wherein the sealing lever handle is mounted for movement in a pivotal over centre action.

10. The latch as claimed in claim 1 wherein pivotal movement of the sealing lever handle causes linear movement of the latch pin.

11. The latch as claimed in claim 10 including a carriage slider which is slidingly mounted on a sliding carriage to which is coupled the latch pin, the carriage slider is pivotally coupled to the sealing lever handle, the sliding carriage being mounted for linear movement, the carriage slider and sliding carriage transforming the pivotal movement of the sealing lever handle into linear movement of the latch pin.

12. The latch as claimed in claim 1 in combination with the striker, the striker including a cam-track in which the latch pin is slidingly engageable.

13. The latch and striker combination as claimed in claim 12 wherein the cam-track is a curved slot which extends from an open end through which the latch pin can enter the slot.

14. The latch as claimed in claim 1 in combination with a striker, the striker including a slot which curves away from an open end via which the latch pin can enter the slot, the latch pin being moveable by the sealing lever handle between:

a first position in the length of the slot in which the window section is in the sealing position; and a second position at the open end of the slot in which the window section is in the venting position with the latch bolt(s) engaged with the striker.

15. The latch combination as claimed in claim 14 including a lever mechanism which upon the latch bolts being operated to release from the striker applies a force to the latch release actuator to cause the latch release actuator to move to a position projecting from the latch furniture such that it can function as a window pull, and being arranged to restrict movement of the latch pin when the latch bolt(s) are not engaged with the striker.

16. The latch combination as claimed in claim 15 wherein the slot is formed as part of a cam-track insert which is removably engaged with a striker mounting base.

17. The latch combination as claimed in claim 13 wherein adjacent the open end of the slot is a damping arm to in use dampen impact by the latch pin.

18. A latch as claimed in claim 1 wherein the latch furniture includes stops to limit the extent of movement of the latch release actuator during operation thereof.

19. The latch as claimed in claim 2 wherein pivotally mounted handle levers are arranged to apply a force to the latch release actuator upon the latch having been actuated to a release position.

20. The latch as claimed in claim 19 further including an anti-slam mechanism arranged to prevent movement of the latch pin other than when the latch bolts are in the closed position.

21. The latch as claimed in claim 1 wherein the latch furniture is arranged to protrude 2 mm or less from the window section.

* * * * *